US012345070B2

(12) United States Patent
Speak et al.

(10) Patent No.: US 12,345,070 B2
(45) Date of Patent: Jul. 1, 2025

(54) SPA SWING APPARATUS

(71) Applicants: Brent Speak, Alpharetta, GA (US); Monica Speak, Alpharetta, GA (US)

(72) Inventors: Brent Speak, Alpharetta, GA (US); Monica Speak, Alpharetta, GA (US)

( * ) Notice: Subject to any disclaimer, the term of this patent is extended or adjusted under 35 U.S.C. 154(b) by 169 days.

(21) Appl. No.: 18/233,528

(22) Filed: Aug. 14, 2023

(65) Prior Publication Data

US 2025/0059789 A1 Feb. 20, 2025

(51) Int. Cl.
*E04H 4/14* (2006.01)
*A45F 3/14* (2006.01)

(52) U.S. Cl.
CPC ..... *E04H 4/14* (2013.01); *A45F 3/14* (2013.01); *A45F 2003/142* (2013.01)

(58) Field of Classification Search
CPC ..... E04H 4/14; A45F 3/14; A45F 2003/142
USPC ..... 4/496
See application file for complete search history.

(56) References Cited

U.S. PATENT DOCUMENTS 1,369,638 A * 2/1921 Edmonds ..... A47K 3/125 4/573.1
1,450,827 A * 4/1923 Wood ..... A47K 3/125 4/573.1
2,257,831 A * 10/1941 Wood ..... A63C 11/001 280/812
4,192,024 A * 3/1980 Zigmont ..... A47K 3/10 5/120
5,000,288 A * 3/1991 Gordon ..... A47C 15/004 182/206
5,010,850 A * 4/1991 Sailer ..... A47D 13/086 182/7
5,608,926 A * 3/1997 Donaton ..... E04H 4/10 126/565
10,602,783 B1 * 3/2020 Colligan ..... A41D 15/04
11,229,277 B1 * 1/2022 Davies ..... A63B 21/169
11,234,522 B1 * 2/2022 Marvin ..... A47C 3/16

* cited by examiner

*Primary Examiner* — Huyen D Le

(57) ABSTRACT

A spa swing apparatus tailored for use alongside water-containing structures, equipped with a water-resistant seating component, adjustable nylon straps with buckle mechanisms, and metallic latching hooks. These hooks interact with specially designed receptacle brackets mounted on the water-containing structures or mount to the lip portion of water containing structures. The apparatus is designed for durability, safety, flexibility, and comfort, making it an ideal addition to hot tubs, jacuzzis, spa baths, swimming pools, and plunge pools.

9 Claims, 6 Drawing Sheets

SPA SWING APPARATUS

FIELD OF INVENTION

The present invention pertains to spa and pool accessories, specifically to an apparatus designed for securely positioning a seating arrangement adjacent to water-containing structures such as hot tubs, jacuzzis, spa baths, swimming pools, and plunge pools.

BACKGROUND

The importance of relaxation and leisure cannot be understated in today's fast-paced world. A significant portion of relaxation for many revolves around water-containing structures such as spas, hot tubs, jacuzzis, swimming pools, and plunge pools. Over the years, these structures have transcended their primary function of being mere water reservoirs to becoming symbols of luxury, relaxation, and wellness. With this growing significance, there has been a constant pursuit to enhance the user experience around these structures, ensuring they provide optimal comfort and functionality.

Traditional seating mechanisms positioned alongside these water-containing structures have often been stationary, bulky, and rigid. While they did serve the primary purpose of providing seating, the lack of flexibility in their design and positioning limited their efficiency. These seating mechanisms were often hard benches or loungers, either made of ceramic, plastic, or at times, even metal. They rarely offered the kind of ergonomic support needed for extended relaxation sessions, making them less than ideal for many users. Prolonged seating often led to discomfort, making what should have been a relaxing experience somewhat tedious.

Moreover, these traditional seating options, due to their stationary nature, lacked adjustability. Furthermore, these fixed seats, once installed, dictated the usable space around the water structure, often causing obstructions or limiting the area for other activities. In scenarios where space was at a premium, such as in urban settings or compact home designs, this inflexibility in seating became even more problematic.

Another significant issue with these traditional seating mechanisms was their resistance to the environment. Water, especially in structures like jacuzzis or swimming pools, often contains chlorine, salts, and other chemicals to ensure cleanliness. Over time, these chemicals can corrode or damage materials that are not specifically designed to withstand such conditions. Metal benches, for instance, risked rusting, while wooden structures might warp or rot. Not only did this degradation diminish the aesthetics of the vicinity, but it also posed potential hazards. Weakened seating could collapse, and corroded structures could lead to injuries.

Maintenance and cleaning were other challenges faced. Fixed structures made it difficult to clean the areas underneath or around them. Algae or mould could build up in these hard-to-reach spots, leading to slippery surfaces and potential health risks. And, if a homeowner decided they no longer wanted the seating, or needed to replace it due to wear and tear, the process of removal was cumbersome and often required professional assistance.

Additionally, the permanence of these fixtures often interfered with the overall aesthetics of the vicinity. While they might be functional, they didn't always align with the evolving design tastes of homeowners. An antique-styled bench might have been a trendy choice a decade ago, but now with modern minimalistic design reigning supreme, such a bench becomes an eyesore.

Given these challenges and limitations with traditional seating mechanisms, there is a clear need for a new kind of seating apparatus. This apparatus would need to blend functionality and comfort, offering flexibility in positioning, while also being durable and resistant to the unique challenges posed by water-containing structures. Furthermore, such a seating apparatus would need to be user-friendly, ensuring that individuals could adjust, move, or even remove the seating as per their preferences without professional intervention.

SUMMARY OF THE INVENTION

In light of the disadvantages mentioned in the previous section, the following summary is provided to facilitate an understanding of some of the innovative features unique to the present invention and is not intended to be a full description. A full appreciation of the various aspects of the invention can be gained by taking the entire specification and drawings as a whole.

The present invention introduces a novel spa swing apparatus tailored for enhanced usability with various water-containing structures. Central to this innovative apparatus is a seating component constructed to optimize user comfort. This seating component is further supported and positioned using two adjustable nylon straps, which are attached to its opposing sides. The flexibility of these straps is ensured through an integrated buckle mechanism, allowing users to alter the length of the straps as per their preference. To securely anchor the seating component to adjacent structures, each nylon strap culminates in a metallic latching hook. These hooks are specially designed to engage with lip portion of water-containing structures such as hot-tubs or receptacle brackets that can be securely mounted onto the sides of water-containing structures. Such a configuration allows the apparatus to offer a comfortable, adjustable, and secure seating position while being adjacent to structures like spas, hot tubs, or pools, ensuring durability, user safety, and convenience.

This summary is provided merely for purposes of summarizing some example embodiments, to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following detailed description and figures.

The abovementioned embodiments and further variations of the proposed invention are discussed further in the detailed description.

DETAILED DESCRIPTION

In the following description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limited sense, and the scope of the present invention is defined only by the appended claims.

The specification may refer to "an", "one" or "some" embodiment(s) in several locations. This does not necessarily imply that each such reference is to the same embodiment(s), or that the feature only applies to a single embodiment. Single feature of different embodiments may also be combined to provide other embodiments.

As used herein, the singular forms "a", "an" and "the" are intended to include the plural forms as well, unless expressly stated otherwise. It will be further understood that the terms "includes", "comprises", "including" and/or "comprising" when used in this specification, specify the presence of stated features, integers, steps, operations, elements and/or components, but do not preclude the presence or addition of one or more other features integers, steps, operations, elements, components, and/or groups thereof. As used herein, the term "and/or" includes any and all combinations and arrangements of one or more of the associated listed items.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1A:
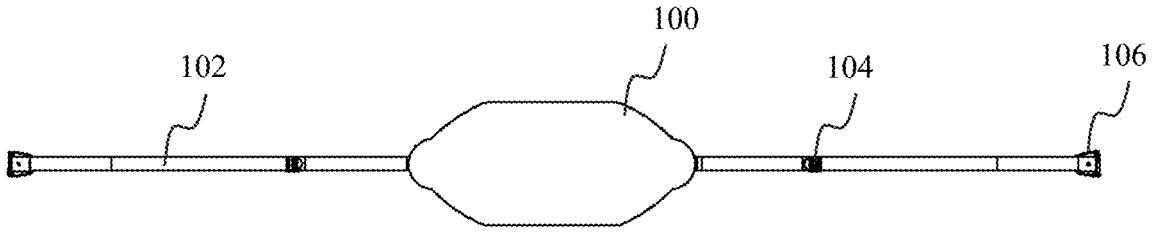
FIG. 1A is an exemplary top view illustration of a spa swing apparatus according to the embodiment of the present disclosure.
Figure 1B:
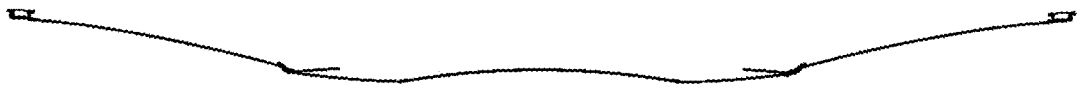
FIG. 1B is an exemplary side view illustration of a spa swing apparatus according to the embodiment of the present disclosure.
Figure 1C:
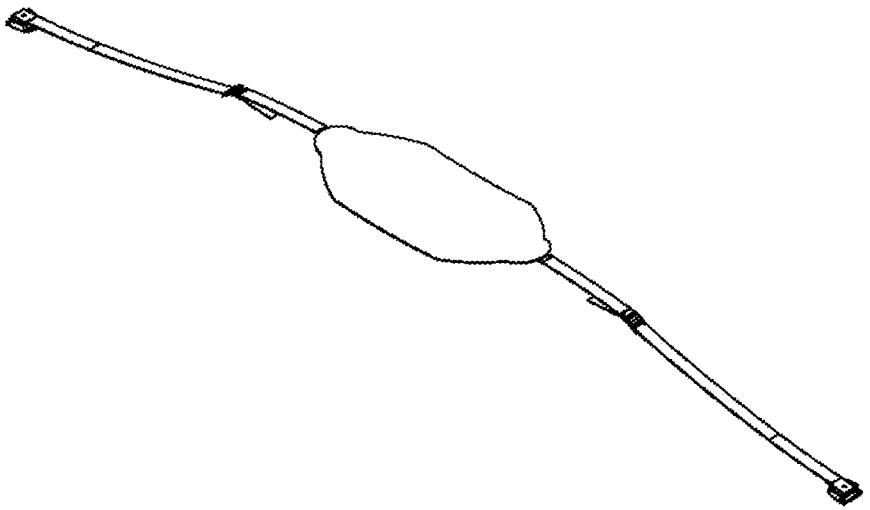
FIG. 1C is an exemplary rear-view illustration of a spa swing apparatus according to the embodiment of the present disclosure.

Referring to FIGS. 1A, 1B, and 1C, the spa swing apparatus is prominently showcased, highlighting its main components. At the centre of the apparatus is the seating component (100). This component is made of water-resistant materials, allowing it to resist damage and wear from continuous exposure to moisture. Additionally, for enhanced comfort, the seating component (100) is either contoured or cushioned to accommodate a user's physique and to provide extended comfort during usage.

From the opposing side portions of the seating component (100) extend two adjustable nylon straps (102). These nylon straps (102) are designed with reinforced fibres, ensuring strength and longevity even under repeated stresses. Along these straps, visual indicators are incorporated to guide users in adjusting to the proper length. Each of these straps is fitted with a buckle mechanism (104). This buckle mechanism (104) is ingeniously designed to resist slippage when under load, ensuring that once adjusted, the seating remains stable and in the desired position.

Figure 2A:
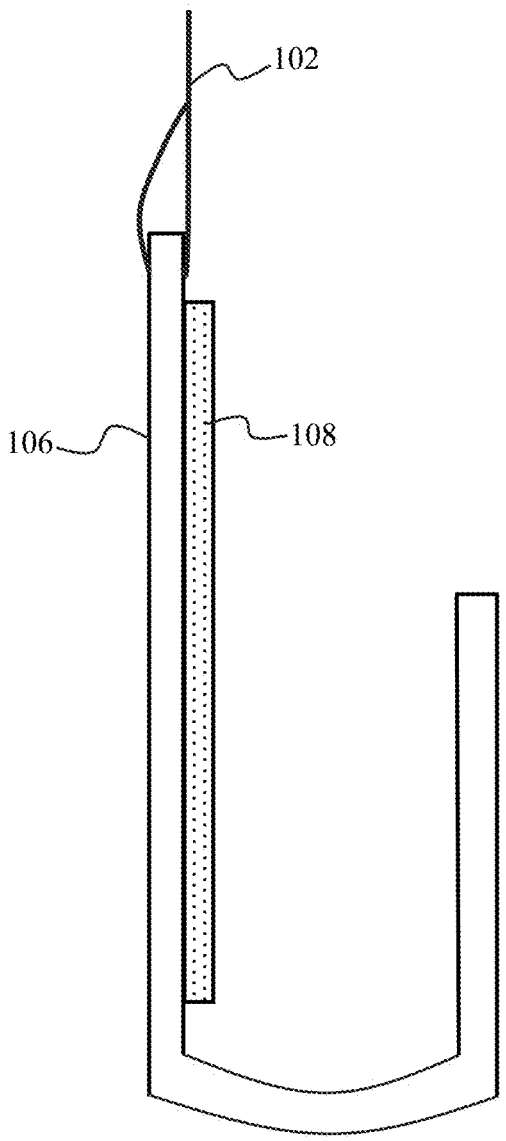
FIG. 2A is an exemplary side view illustration of a metallic latching hook according to the embodiment of the present disclosure.
Figure 2B:
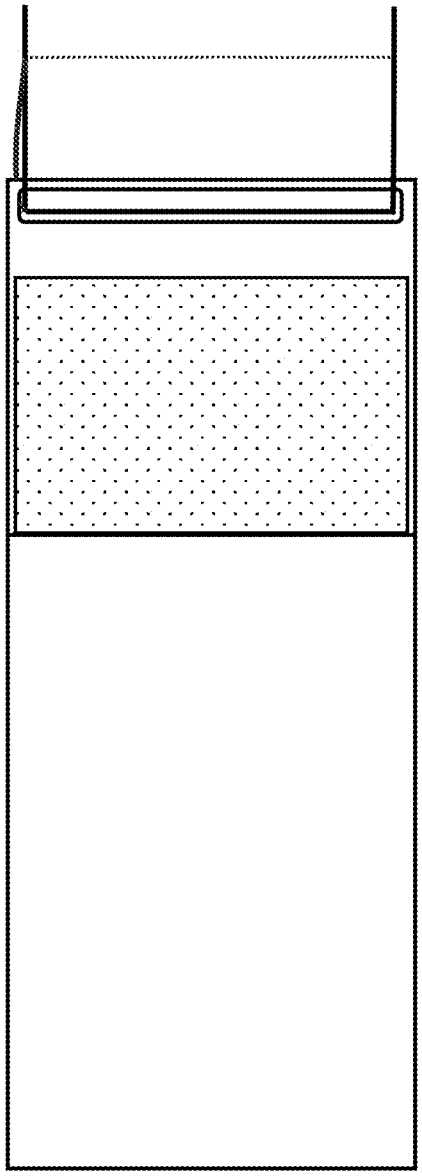
FIG. 2B is an exemplary front view illustration of a metallic latching hook according to the embodiment of the present disclosure.
Figure 2C:
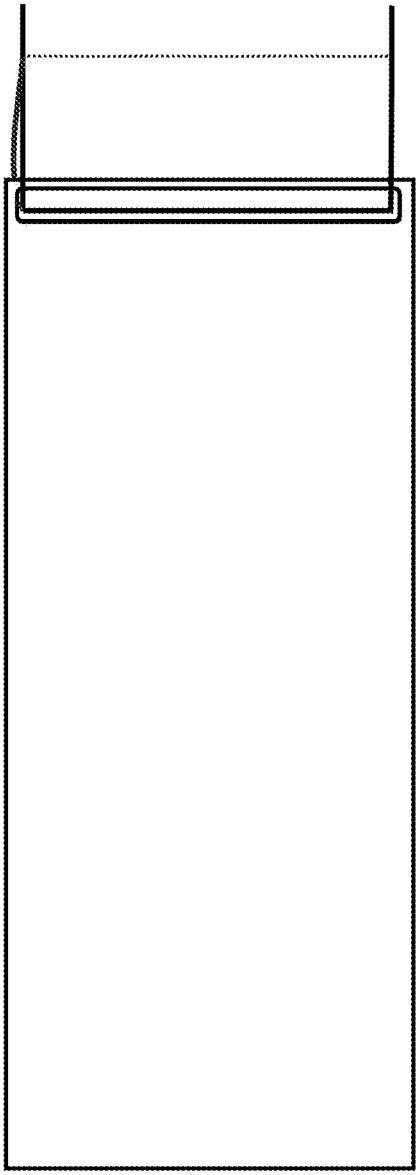
FIG. 2C is an exemplary rear-view illustration of a metallic latching hook according to the embodiment of the present disclosure.

At the free end of each of these nylon straps (102) are metallic latching hooks (106). As seen in FIGS. 2A, 2B, and 2C, these latching hooks (106) are made of corrosion-resistant metal, safeguarding them from potential degradation when in constant contact with water, especially chlorinated or saltwater. An added feature in these latching hooks (106) is the inclusion of silicone padding (108) on one side of their interior portion. This silicone padding (108) is implemented to prevent scratches or damages when these hooks are latched onto the receptacle brackets or other surfaces such as lip-portions of hot-tubs, etc.

Figure 3A:
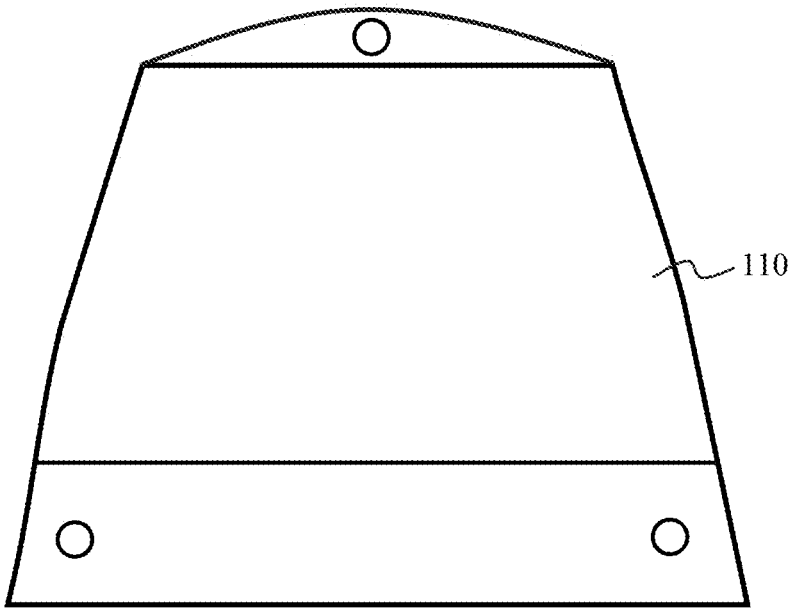
FIG. 3A is an exemplary front view illustration of a receptacle bracket according to the embodiment of the present disclosure.
Figure 3B:
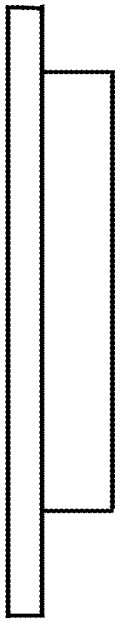
FIG. 3B is an exemplary side view illustration of a receptacle bracket according to the embodiment of the present disclosure.
Figure 3C:
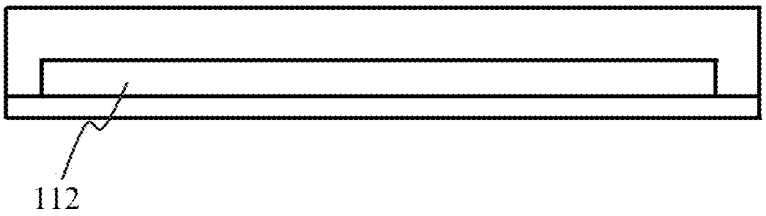
FIG. 3C is an exemplary bottom view illustration of a receptacle bracket according to the embodiment of the present disclosure.

Moving to FIGS. 3A, 3B, and 3C, the receptacle brackets (110) are showcased. These brackets are designed to be securely mounted onto the sides of water-containing structures. They can be fastened using various means, ensuring a tight fit. Each of these receptacle brackets (110) features an opening (112) tailored to securely accommodate and hold the metallic latching hooks (106). Furthermore, to enhance safety and security, the receptacle brackets (110) come equipped with a locking mechanism. This ensures that once the latching hooks (106) are in place, accidental disengagement is prevented. Moreover, for instances where swift detachment is required, a safety release mechanism is integrated into the receptacle brackets (110). The receptable brackets (110) may be used when the water-containing structure lacks lip-portions that are able to accommodate the latching hooks.

Referring to the embodiment showcased in the drawings, a holistic comprehension of the spa swing apparatus is elucidated.

Seating Component (100)

Central to the spa swing apparatus is the seating component (100). This isn't just a rudimentary slab of material; it's meticulously designed to prioritize user comfort and ergonomic support. Think of this component as the heart of the invention, being the primary contact point for the user. Its design can vary from a simplistic flat surface to more intricate designs that might be contoured or cushioned, adapting to the human anatomy, thus reducing pressure points and ensuring maximum relaxation.

Constructed from water-resistant materials, the seating component (100) addresses the longstanding issue of material degradation due to prolonged exposure to water and the chemicals often present in water-containing structures. This material choice ensures that users don't have to be concerned about frequent replacements or maintenance.

Nylon Straps (102)

Emerging from the opposite sides of the seating component (100) are two adjustable nylon straps (102). Nylon, known for its durability, elasticity, and resistance to environmental conditions, becomes a prime choice for these straps. This ensures that even under the humid and often chlorinated surroundings of pools and spas, the straps maintain their integrity over time.

The straps (102) are not just flat bands but have been reinforced as per claim 8. This reinforcement augments their weight-bearing capability, ensuring they don't stretch or snap when under load, thereby safeguarding the user. Additionally, for users who might be overwhelmed with the adjustment process, the nylon straps come with visual indicators. These indicators act as guides, helping users identify the optimal length for their comfort and safety.

Buckle Mechanism (104)

Each nylon strap (102) is equipped with a buckle mechanism (104), which serves a dual purpose. First, it allows users to adjust the length of the straps, ensuring the seating component (100) is at the desired height relative to the water surface. Second, given its unique design, it resists slippage when under load. This feature is crucial to user safety. Imagine a scenario where a user sits, and a poorly designed buckle gives in, adjusting the strap's length involuntarily; it can be disconcerting at the least and hazardous at worst. The anti-slippage design of the buckle mechanism (104) negates such risks.

Metallic Latching Hooks (106)

The free ends of the nylon straps (102) are furnished with metallic latching hooks (106). These aren't ordinary hooks but are crafted from corrosion-resistant metal, ensuring longevity even when frequently exposed to water and the ambient moisture of spa or pool environments.

But the inventiveness doesn't halt there. Delving deeper into the latching hook's design, one would notice a silicone padding (108) on the interior portion of the hook on one side. This padding acts as a cushion, preventing the hooks from scratching or damaging the receptacle brackets (110) they latch onto. Furthermore, it provides an additional grip, ensuring the hook remains securely in place, minimizing the chances of inadvertent disengagements.

Receptacle Brackets (110)

In some scenarios, the water-containing structure may not comprise lip portions to securely hold the latching hooks. In such scenarios, to securely anchor the seating component (100) adjacent to water-containing structures, there are receptacle brackets (110). These brackets, sculpted to perfection, are designed to accommodate the metallic latching hooks (106). The brackets can be securely mounted onto the sides of structures using robust fasteners. These are not mere holding slots but come with an in-built locking mechanism, further enhancing the apparatus's security.

One standout feature of these brackets is the safety release mechanism, in case of emergencies or the need for quick disassembly, this mechanism ensures the apparatus can be detached swiftly and safely.

Opening for Latching Hooks (112)

The latching hooks (112) may be easily un-hooked from the lip-portion of water containing structures easily as understood by a person skilled in the art. In cases where receptable brackets (110) are used, they have been designed with a specific opening (112) tailored to snugly fit the metallic latching hooks (106). This design ensures the swift and secure assembly of the seating component (100) to the water-containing structure. What's truly remarkable is that this combination of latching hooks and receptacle bracket has been tailored for quick assembly and disassembly by users. This means users don't have to be mechanically inclined or possess specialized tools to enjoy the benefits of the spa swing apparatus.

Certainly, an essential facet of the spa swing apparatus's versatility is its adaptability to various installation scenarios. In certain configurations, particularly when interacting with the lips of hot tubs or similar water-containing structures that have sturdy, protruding edges, the need for the receptacle brackets (110) can be rendered obsolete. The metallic latching hooks (106) are adeptly designed to directly engage with these edges. By latching onto the robust lips of such structures, the apparatus offers a streamlined, fuss-free assembly process. This direct latching mechanism not only simplifies installation but also reduces the hardware footprint, providing a cleaner and more minimalist appearance. Such flexibility accentuates the spa swing apparatus's user-centric design, catering to diverse structural designs and user preferences. Whether with the receptacle brackets for flat-sided structures or directly onto the pronounced lips of other designs, the apparatus ensures reliable and secure seating every time.

The present spa swing apparatus offers several advantages:

Flexibility: The adjustable straps allow users to customize the height and position of the seating component as per their comfort.

Durability: With corrosion-resistant metallic hooks, water-resistant seating, and reinforced nylon straps, the apparatus ensures longevity.

Safety: The integration of locking mechanisms and safety release features ensures user safety at all times.

Ease of Use: Visual indicators on straps and quick assembly and disassembly mechanisms make the apparatus user-friendly.

Comfort: The contoured or cushioned seating component guarantees maximum comfort for extended usage.

It may be noted that the above-described examples of the present solution are for the purpose of illustration only. Although the solution has been described in conjunction with a specific embodiment thereof, numerous modifications may be possible without materially departing from the teachings and advantages of the subject matter described herein. Other substitutions, modifications and changes may be made without departing from the spirit of the present solution. All the features disclosed in this specification (including any accompanying claims, abstract and drawings), and/or all of the steps of any method or process so disclosed, may be combined in any combination, except combinations where at least some of such features and/or steps are mutually exclusive.

The terms "include," "have," and variations thereof, as used herein, have the same meaning as the term "comprise" or appropriate variation thereof. Furthermore, the term "based on", as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter.

What is claimed is:

1. A spa swing apparatus for use with water-containing structures, comprising:

a seating component;

two adjustable nylon straps, each strap attached to opposing side portions of the seating component and equipped with a buckle mechanism for length adjustment;

metallic latching hooks affixed to free end of each of the nylon straps, said hooks adapted to directly engage with a lip portion of the water-containing structures; and receptacle brackets securely mountable onto sides of the water-containing structures, the receptacle brackets shaped to accommodate and securely hold the latching hooks.

2. The spa swing apparatus of claim 1, wherein the receptacle bracket includes a locking mechanism.

3. The spa swing apparatus of claim 1, wherein the latching hook and receptacle bracket are designed for quick assembly and disassembly by a user.

4. The spa swing apparatus of claim 1, wherein the latching hook is constructed of a corrosion-resistant metal.

5. The spa swing apparatus of claim 1, wherein the buckle mechanism resists slippage when under load.

6. The spa swing apparatus of claim 1, wherein the seating component is designed with water-resistant materials.

7. The spa swing apparatus of claim 1, wherein the nylon straps are reinforced.

8. The spa swing apparatus of claim 1, wherein the seating component is contoured or cushioned.

9. The spa swing apparatus of claim 1, wherein the water-containing structure is selected from the group consisting of: hot tubs, jacuzzis, spa baths, swimming pools, and plunge pools.

* * * * *